United States Patent [19]

Branovich et al.

[11] Patent Number: 4,708,681

[45] Date of Patent: Nov. 24, 1987

[54] METHOD OF MAKING A LONG LIVED HIGH CURRENT DENSITY CATHODE FROM TUNGSTEN AND IRIDIUM POWDERS

[75] Inventors: Louis E. Branovich, Howell Township, Monmouth County; Gerard L. Freeman, Freehold Township, Alleghany County; Bernard Smith, Ocean, all of N.J.

[73] Assignee: The United States of America as represented by the Secretary of the Army, Washington, D.C.

[21] Appl. No.: 23,161

[22] Filed: Mar. 6, 1987

[51] Int. Cl.[4] ..... H01J 9/04; H01J 9/12

[52] U.S. Cl. ..... 445/50; 445/46; 445/51

[58] Field of Search ..... 445/35, 46, 49, 50, 445/51

[56] References Cited

U.S. PATENT DOCUMENTS

| | | | |
|---|---|---|---|
| 4,078,900 | 3/1978 | Smith | 445/51 |
| 4,236,287 | 2/1980 | Smith | 445/51 |
| 4,444,718 | 4/1984 | Smith | 445/46 |

FOREIGN PATENT DOCUMENTS

| | | | |
|---|---|---|---|
| 0001046 | 1/1980 | Japan | 445/51 |

*Primary Examiner*—Kurt Rowan

*Attorney, Agent, or Firm*—Sheldon Kanars; Jeremiah G. Murray; Roy E. Gordon

[57] ABSTRACT

A long lived high current density cathode is made from a mixture of tungsten and iridium powders by processing the mixture of powders with an activator into a porous billet, and then impregnating the billet with a chemical mixture of barium oxide, strontium oxide, and aluminum oxide by firing the billet in a dry hydrogen furnace at a temperature at which the impregnant melts.

5 Claims, No Drawings

METHOD OF MAKING A LONG LIVED HIGH CURRENT DENSITY CATHODE FROM TUNGSTEN AND IRIDIUM POWDERS

The invention described herein may be manufactured, used, and licensed by or for the Government for governmental purposes without the payment to us of any royalty thereon.

This invention relates in general to a method of making a long lived high current density cathode and in particular, to a method of making such a cathode from a mixture of tungsten and iridium powders.

BACKGROUND OF THE INVENTION

There has been a need for a long lived high current density cathode to operate in microwave devices. Heretofore, attempts at making such cathodes that have been most successful have involved impregnating a suitable matrix such as a porous tungsten billet with a mixture of barium oxide, calcium oxide, and aluminum oxide and then sintering the billet at a temperature at which the impregnant melts. This provides the barium atoms that are needed for the generation of electrons. The difficulty with these cathodes is that they usually have a maximum current density capability of 2 to 4 amperes/cm$^2$ at 1050° C. which density is too low.

SUMMARY OF THE INVENTION

The general object of this invention is to provide a method of making a long life high current density cathode. A more particular object of the invention is to provide such a method wherein the resulting cathode will be suitable for use in microwave devices.

It has now been found that the aforementioned objects can be attained by forming a porous billet from a mixture of tungsten and iridium powders and then impregnating the billet with a chemical mixture of barium oxide, strontium oxide, and aluminum oxide.

More particularly, according to the invention, a long life high current density cathode suitable for operation in microwave devices is made from a mixture of tungsten and iridium powders by a method including the steps of:

(A) mixing tungsten and iridium powders in a weight ratio of 60 weight percent tungsten to 39 weight percent iridium, (B) adding 1 percent by weight of zirconium hydride to the mixture, (C) ball milling the mixture for about 8 hours, (D) pressing the ball milled mixture into a billet at about 48,000 p.s.i. in a die, (E) sintering the billet at 1800° C. for ½ hour in dry hydrogen of less than −100 dewpoint, (F) backfilling the billet with copper in dry hydrogen at 1150° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with a chemical mixture of barium oxide, strontium oxide, and aluminum oxide, by firing the billet in a dry hydrogen furnace at a temperature at which the impregnant melts for about two minutes, (L) removing the billet from the furnace after the furnace is cooled, and (M) removing any loose pieces of impregnant from the billet. .

DESCRIPTION OF THE PREFERRED EMBODIMENT

A long lived high current density cathode is made in the following manner. Tungsten and iridium powders are mixed in a weight ratio of 60 weight percent tungsten to 39 weight percent iridium. 1 percent by weight of zirconium hydride activator is added to the mixture and the mixture ball milled for about 8 hours. The ball milled mixture is then pressed into a billet at about 48,000 p.s.i. in a die and the billet then sintered at 1800° C. for ½ hour in dry hydrogen of less than −100 dewpoint. The billet is then backfilled with copper in dry hydrogen at 1150° C., the billet machined to the desired geometry, and the copper then removed by etching in nitric acid. The porous billet is then thoroughly rinsed in deionized water, methanol and then dried. The billet is then hydrogen fired at about 1400° C. for about 15 minutes. The billet is then impregnated with a chemical mixture containing $6BaO/1SrO/2Al_2O_3$ by firing the billet in a hydrogen furnace at about 1600° C. for two minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures. The cathode gives current densities of 18 A/cm$^2$ at 1075° C. At higher temperatures, this cathode gives current densities in excess of 80 A/cm$^2$.

The cathode operation is similar to other cathode operations. That is, it is heated in vacuum, and a chemical reaction takes place and barium atoms are released which coat the cathode surface.

The rate of barium atom formation is much faster at the same operating temperature in the case of the tungsten-iridium billet than the normal tungsten billet.

In the method of the invention, a small amount of an activator as for example, zirconium hydride is included in the billet. The activator enhances the generation of barium atoms at the cathode operating temperature.

Similarly, in the method of the invention, in lieu of impregnating with a 6:1:2 ratio of BaO, to SrO, to $Al_2O_3$, one may use other ratios, as for example, a 5:3:2 ratio, a 4:1:1 ratio, or a 5:2:1 ratio.

We wish it to be understood that we do not desire to be limited to the exact details of construction as described for obvious modifications will occur to a person skilled in the art.

What is claimed is:

1. Method of making a long lived high current density cathode suitable for operation in microwave devices from tungsten and iridium powders including the steps of:

(A) mixing the tungsten and iridium powders, (B) adding about 2 percent by weight of an activator to the mixture, (C) ball milling the mixture for about 8 hours, (D) pressing the ball milled mixture into a billet at about 48,000 p.s.i. in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with a chemical mixture of barium oxide, strontium oxide, and aluminum oxide, by firing the billet in a dry hydrogen furnace at a temperature at which the impregnant melts for about two minutes, (L) removing the billet from the furnace after the furnace is cooled, and (M) removing any loose pieces of impregnant from the billet.

2. Method of making a long lived high current density cathode according to claim 1 wherein in step (A), the tungsten and iridium, powders are mixed in a weight ratio of about 60 weight percent tungsten to about 39 weight percent iridium.

3. Method of making a long lived high current density cathode according to claim 1 wherein in step (B), the activator is about 1 weight percent zirconium hyride.

4. Method of making a long lived high current density cathode according to claim 1 wherein step (K), the chemical mixture is $6BaO/1SrO/2Al_2O_3$ and the firing temperature is about 1600° C.

5. Method of making a long lived high current density cathode suitable for operation in microwave devices from tungsten and iridium powders including the steps of:

(A) mixing the tungsten and iridium powders in the weight ratio of about 60 weight percent tungsten to about 39 weight percent iridium, (B) adding about 1 percent by weight of zirconium hydride to the mixture, (C) ball milling the mixture for about 8 hours, (D) pressing the ball milled mixture into a billet at about 48,000 p.s.i. in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes, (K) impregnating the billet with a chemical mixture of $6BaO/1SrO/2Al_2O_3$ by firing the billet in a dry hydrogen furnace at about 1550° C. for about 2 minutes, (L) removing the billet from the furnace after the furnace is cooled, and (M) removing any loose pieces of impregnant from the billet.

* * * * *